US006311369B1

(12) United States Patent
Ryu

(10) Patent No.: US 6,311,369 B1
(45) Date of Patent: Nov. 6, 2001

(54) VIBRATION DAMPENING TOOL HANDLE

(75) Inventor: Suk-Ho Ryu, Seoul (KR)

(73) Assignee: Wavex Corporation, Toronto (CA)

( * ) Notice: Subject to any disclaimer, the term of this patent is extended or adjusted under 35 U.S.C. 154(b) by 0 days.

(21) Appl. No.: 09/378,092

(22) Filed: Aug. 20, 1999

(51) Int. Cl.[7] ..... B25D 1/12; B25G 3/00

(52) U.S. Cl. ..... 16/436; 16/430; 16/431; 16/DIG. 18; 81/22; 81/177.1; 81/489

(58) Field of Search ..... 16/436, 430, 431, 16/421, 902, DIG. 18, DIG. 19, DIG. 12; D8/303, 313, 315, 75–81; 81/20–22, 177.1, 489

(56) References Cited

U.S. PATENT DOCUMENTS

| | | | | |
|---|---|---|---|---|
| D. 372,743 | * | 8/1996 | Ringo | D8/77 |
| 479,032 | | 7/1892 | Surbaugh . | |
| 1,341,378 | | 5/1920 | McKenzie . | |
| 1,401,896 | | 12/1921 | Ehrhart . | |
| 2,155,804 | | 4/1939 | Rubin . | |
| 2,337,440 | * | 12/1943 | Arrowood | 81/22 |
| 2,603,260 | * | 7/1952 | Floren | 81/22 |
| 2,940,492 | * | 6/1960 | Curry et al. | 81/22 |
| 3,216,052 | * | 11/1965 | Hill | 16/421 |
| 3,770,033 | | 11/1973 | Gavillet et al. . | |
| 4,266,588 | * | 5/1981 | Tudiscl | 81/22 |
| 4,683,875 | * | 8/1987 | Rabinowitz | 128/862 |
| 4,738,166 | * | 4/1988 | Yamaguchi | 81/22 |
| 5,038,472 | * | 8/1991 | Iderosa | 30/87 |
| 5,348,360 | | 9/1994 | Mencarelli et al. . | |
| 5,375,486 | | 12/1994 | Camien . | |
| 5,588,343 | | 12/1996 | Rust et al. . | |
| 5,657,674 | | 8/1997 | Burnett . | |
| 5,678,316 | | 10/1997 | Althaus et al. . | |

* cited by examiner

*Primary Examiner*—Chuck Y. Mah
(74) *Attorney, Agent, or Firm*—Maria Parrish Tungol; John A. Parrish

(57) ABSTRACT

The invention relates to a tool handle having a core that has a tool engaging end, an intermediate section, and a grip end. One or more rigid molded layers at least partially cover at least the intermediate section. The rigid molded layers include an outermost rigid layer having an undulated outer surface. The outermost rigid layer can include a portion that at least partially surrounds the grip end. In one aspect, that portion of the outermost rigid layer that surrounds the intermediate section is undulated and that portion of the outermost rigid layer that surrounds the grip end is free of undulations. The tool handles according to the invention dampen vibration that is transmitted from the impact end of the tool handle to the grip end that is held by the user. The invention also relates to impact tools having tool handles that dampen vibration before it is transmitted from the head to the grip section of the handle.

26 Claims, 3 Drawing Sheets

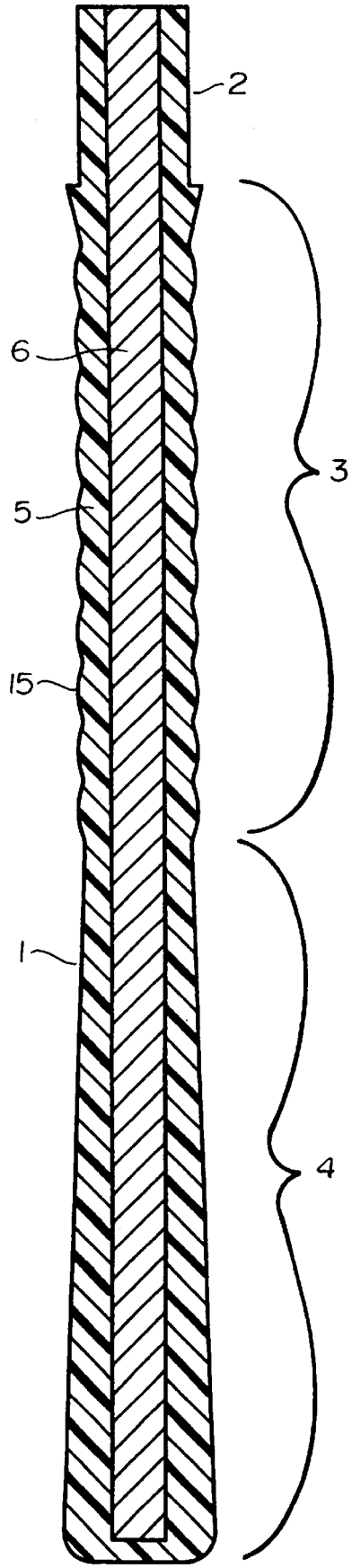
FIG. 3
FIG. 4
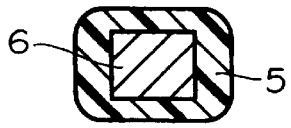
FIG. 5
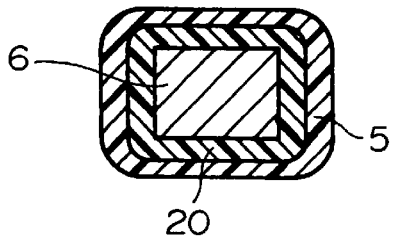

VIBRATION DAMPENING TOOL HANDLE

FIELD OF THE INVENTION

The present invention relates to tool handles, more particularly to tool handles which dampen vibration. The present invention also relates to impact tools having tool handles which dampen vibration.

BACKGROUND OF THE INVENTION

When used as part of an impact tool, such as a hammer, axe, hatchet, pick, or shovel, the handle must be securely gripped to apply maximum force and to maintain control of the tool during use. However, upon impact, vibration is transmitted from the impact end of the tool handle along the tool handle to the grip end that is held by the user. Reduction of vibration frequency and/or vibration duration decreases painful vibration to the user's hand and arm and permits the user to maintain a tight grasp on the grip end of the handle. The user is thus able to maintain better control over the tool during and after impact.

Over the years, reduction of vibration has been sought in tool handles for impact tools. In U.S. Pat. No. 1,401,896, metal wire was wrapped around a reduced wooden handle to produce elasticity or resilience and reduce shock or injury to the hand of the user. U.S. Pat. No. 479,032 also discloses a hammer handle made of a metal core with metal wire coiled around the core. Metal wire is also used around the handles disclosed in U.S. Pat. No. 2,155,804 to reinforce a wooden handle. Another example of wire wrapped around a tool handle is disclosed in U.S. Pat. No. 1,341,378.

Tool handles made from synthetic resins, particularly composite materials, have replaced wooden handles in many applications because of their superior strength and durability. Such tool handles and their compositions are known in the art as disclosed in U.S. Pat. Nos. 3,770,033, 5,375,486, 5,588,343, and 5,657,674, all herein incorporated by reference. However, the vibration transmitted to the user of non-wood handles is higher. This is especially true with hammers having internal metal cores surrounded by a molded plastic shell. The vibration dampening property of non-wood handles can be one hundred to one thousand times less than a comparable wood handle.

Prolonged use of such non-wood handles can quickly tire the hand and arm muscles of the user. Besides affecting the comfort and productivity of the user, extended use can result in physiological damage to the hand, arm, and/or shoulder of the user.

U.S. Pat. No. 5,348,360 discloses a common method of reducing vibration by means of a soft material around the sections of the handle that are held by the user. These gripping devices cushion the user's hand against vibration and abrasion. To be effective, the devices must be held by the user during use of the tool. These devices are typically attached to the external surface of the tool handle by means of adhesives. As noted in the reference, such devices become worn the extent that they require periodic replacement so the design and attachment of the material must accommodate removal and replacement.

U.S. Pat. No. 5,588,343 relates to a handle having core member and synthetic resin sleeve wherein the core member has a channel therein extending from the grip end over a portion of its length. U.S. Pat. No. 5,657,674 discloses a body of a hammer that includes an elongated member with a cradle connected to and extending generally normal to the elongated member. In U.S. Pat. No. 5,704,259, a tuned vibration absorber is attached to the handle to reduce vibration. U.S. Pat. No. 5,772,541 adds a chamber on an implement with a handle and a freely movable elastomeric member disposed in the chamber to reduce vibration. The handle disclosed in U.S. Pat. No. 5,911,795 has spaced apertures along the length of its core member and a vibration dampening canister in the handle.

The means for vibration dampening disclosed in the prior art require significant changes and/or additions to the design of the tool handle. These changes and additions increase the cost and complexity of manufacture. Addition of elements to the handle may increase the size and weight of the handle and the likelihood that the elements will be damaged during use of the tool.

The tool handles according to the invention reduce vibration frequency and/or vibration duration. They do not require additional constructions such as canisters or channels to tool handle so extensive re-design of tool handles and methods of manufacture that are currently available is not required. Unlike the soft cushioning devices of the prior art, the tool handles do not become easily 30 worn or require replacement. The attractive aesthetic appearance of the tool handle can be varied while maintaining the advantageous vibration dampening properties.

SUMMARY OF THE INVENTION

The invention relates to a tool handle having a core that has a tool engaging end, an intermediate section, and a grip end. One or more rigid molded layers at least partially cover at least the intermediate section. The rigid molded layers include an outermost rigid layer having an undulated outer surface. The outermost rigid layer can include a portion that at least partially surrounds the grip end. In one aspect, that portion of the outermost rigid layer that surrounds the intermediate section is undulated and that portion of the outermost rigid layer that surrounds the grip end is free of undulations.

In another aspect, that portion of the outermost rigid layer that surrounds the intermediate section is undulated and that portion of the outermost rigid layer that surrounds the grip end is undulated. The outer surface of the outermost molded layer that surrounds the intermediate section of the core can have 4 to 11 undulations. The undulations can be equidistantly spaced along the outer surface of the outermost molded layer, and can extend around the circumference of the outermost molded layer.

In another aspect, the invention relates to a tool which includes a tool handle having a core that has a tool engaging end, an intermediate section, and a grip end. One or more rigid molded layers at least partially surround at least the intermediate section. The rigid molded layers include an outermost rigid layer having an undulated outer surface.

BRIEF DESCRIPTION OF THE DRAWINGS

FIG. 3 is a longitudinal sectional view of a first embodiment of the tool handle of the invention along line 10—10 shown in FIG. 2.

FIG. 4 is a sectional view of a first embodiment of the tool handle along line 11—11 shown in FIG. 2.

FIG. 5 is a sectional view of a second embodiment of the tool handle having more than one layer surrounding the core.

DETAILED DESCRIPTION OF THE INVENTION

Figure 1:
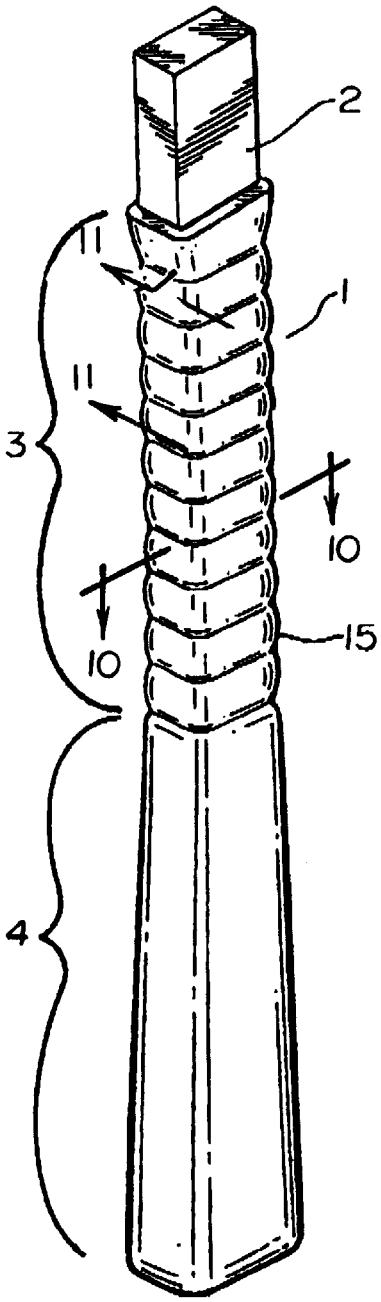
FIG. 1 is a perspective view of a first embodiment of the invention in which the outer surface of the outermost layer surrounding the grip end of the core is free from undulations.

The present invention can have various embodiments including the embodiments shown in the drawings and described hereafter. The embodiments described herein are non-limiting examples of the invention. The detailed description of the embodiments hereinafter is not intended to limit the invention to the embodiments that are described.

FIG. 1 shows a preferred embodiment of tool handle 1 in which the molded layer completely covers head engaging end 2, intermediate section 3 and grip end 4 of core 6 that is shown in sectional view in FIG. 3. The outer surface of molded layer 5 surrounding intermediate section 3 is undulated. The outer surface of undulated molded layer 5 contains a plurality of undulations that are evenly spaced longitudinally along the length of said outermost layer. The undulations shown in FIG. 1 have an arc shaped configuration and extend around the circumference of the tool handle.

Figure 2:
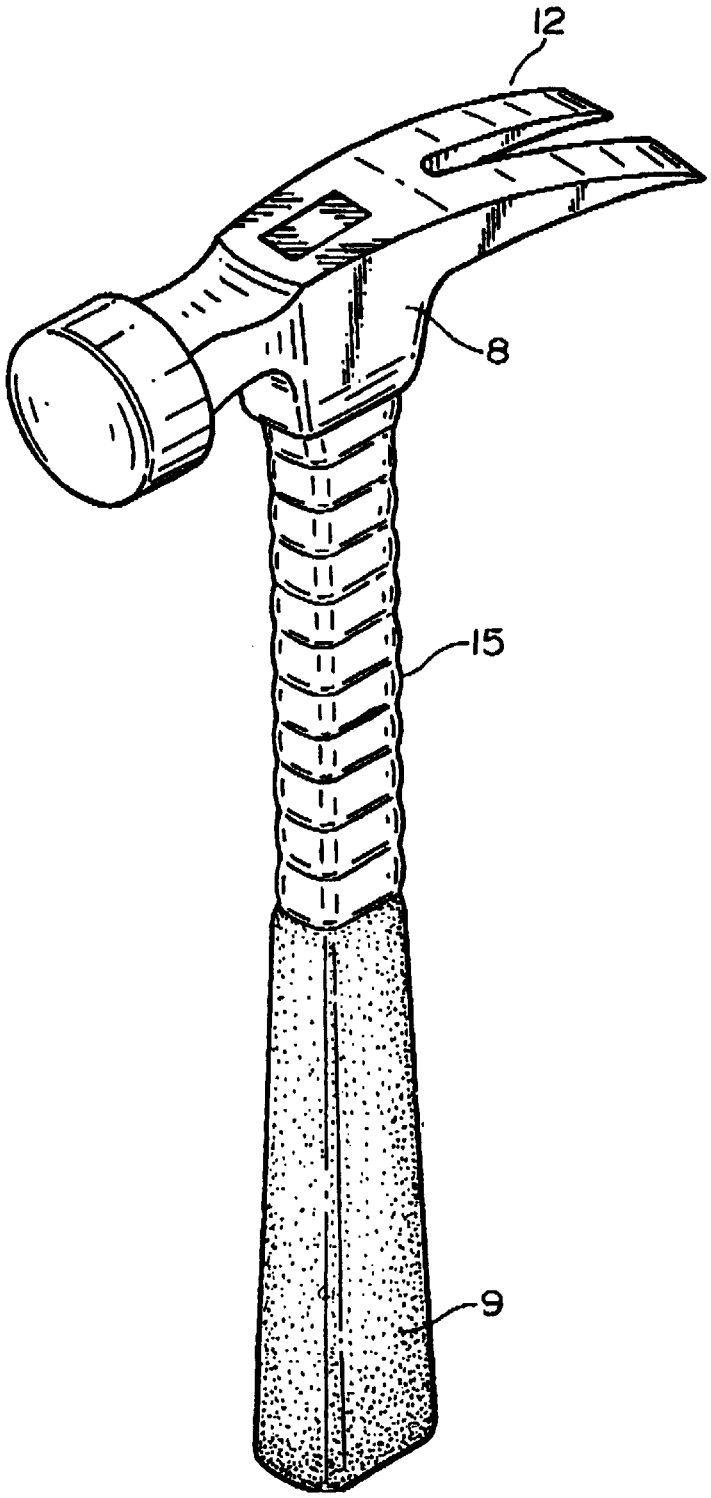
FIG. 2 is a perspective view of a first embodiment of the tool handle of the invention attached to a claw hammer head and having a covering over the grip end.

FIG. 2 shows the tool handle used as a hammer handle with head 8 and grip cover 9.

FIG. 3 is a longitudinal sectional view along line 10—10. The head engaging end 2, intermediate section 3, and grip end 4 of core 6 are completely covered by the molded layer 5. A series of undulations 15 extends along the length of the outer surface of the rigid layer covering intermediate section 3. FIG. 4 is a sectional view along line 11—11 showing one molded layer 5 surrounding core 6. FIG. 5 is a sectional view along line 11—11 showing an alternative embodiment in which two molded layers surround the core 6. In this embodiment, inner layer 20 surrounds the core 6 and outermost layer 5 surrounds both core 6 and inner layer 20.

The undulations shown in the figures are curved or arc shaped. This particular shape produces an attractive aesthetic appearance of the tool handle. However, the undulations can have other shapes such as a triangular shape or a rectangular shape depending upon the desired appearance of the handle and desired effect on vibration dampening. The undulations are preferably evenly distributed along the length and around the circumference of the outer surface covering the intermediate section as shown in the drawings. The drawings also show the preferred orientation of the undulations transverse to the direction of the vibration and in line with the axis of the core. However, the distribution and orientation of the undulations can be varied to achieve a desired effect on vibration dampening and/or desired appearance of the tool handle. For example, the undulations can extend partially around the circumference of the rigid layer. The undulations can be limited to opposing surfaces of the handle with the adjacent surfaces free from undulations. There can be more than one series of undulations on the outer surface. The undulations can be oriented at an angle from the axis of the core. Although the orientation that is transverse to the direction of vibration is preferred, other embodiments include undulations that spiral around the circumference of the outermost rigid layer.

Figure 7:
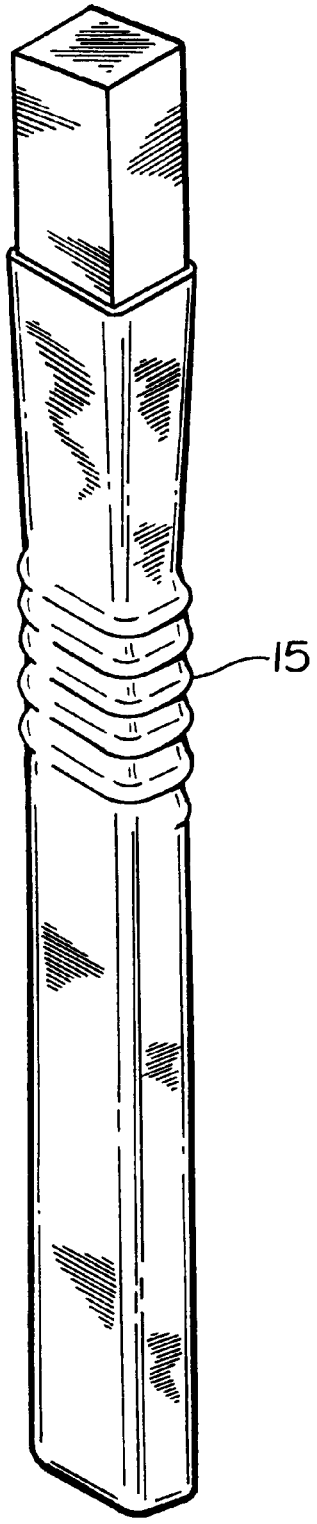
FIG. 7 is a perspective view of a fourth embodiment of the tool handle of the invention in which only a portion of the outermost layer surrounding the intermediate section of the core is undulated.

The vibration dampening effect of the tool handle of the present invention has been observed with undulations as small as about 0.5 to 1 mm high (peak-to-trough) with a frequency (peak-to-peak distance) of about 12 mm in tool handles such as the embodiments shown in the drawings. In other embodiments, the undulations can be non-uniform in size and can vary in size and shape within a particular series of undulations. The height and frequency of the undulations can be varied to achieve a desired level of vibration dampening effect and/or aesthetic appearance of the tool handle. The number of undulations in the outer surface can likewise be varied to achieve a desired effect. Typically there is more than one undulation, preferably as a series of undulations. As shown in FIGS. 1 and 7, a preferred number of undulations on the outer surface of the intermediate section ranges from 4 to 11 undulations.

As stated previously, the distribution of the undulations can be varied. For example, there can be more than one series of undulations at different locations on the outermost layer. Embodiments such as those shown in FIGS. 1 and 2 typically have one series having 9 to 11 undulations. Embodiments such as that shown in FIG. 7 can have one series with as few as four undulations. The maximum number of undulations is limited by the dimensions of the outermost rigid layer relative to the size, frequency, and distribution of the undulations.

Various modifications to characteristics of the undulations such as the shape, number, and size can be made depending upon the nature of the tool and the physical properties of the tool handle sections such as stiffness, thickness, Youngs Modulus of Elasticity and the like.

The undulations of the outermost molded layer 5 dampen vibration transmitted through the outer layer covering the intermediate section 3 that is located between the head engaging end 2 and the grip end 4. Accordingly, at least part of the outermost layer 5 covering the intermediate section 3 of the core 6 is undulated as shown in FIGS. 1, 2, and 3. As shown in these figures, a preferred embodiment of the present invention is a tool handle in which the outermost layer surrounding the intermediate section has an undulated surface. The outermost layers surrounding the head engaging end 2 and the grip end 4 are not undulated. Tool handles according to this embodiment typically have about 9 to about 11 undulations.

Figure 6:
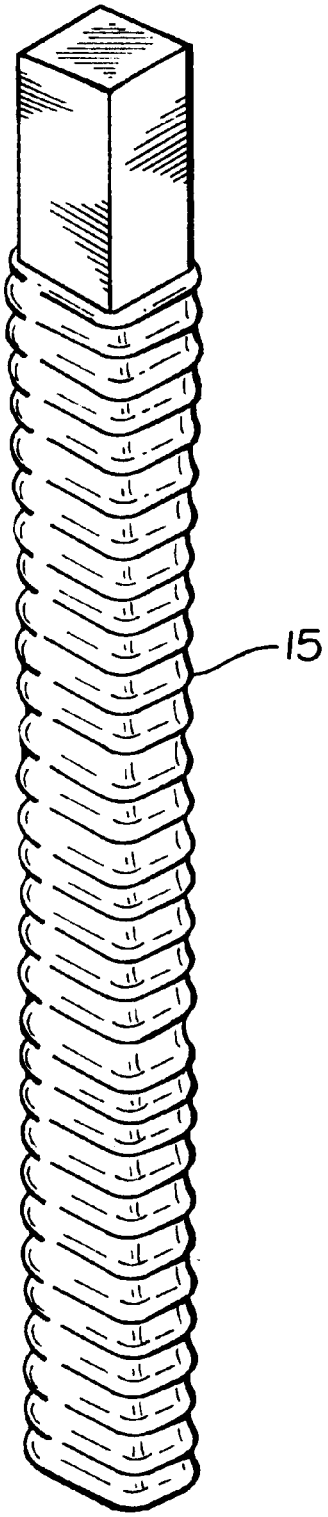
FIG. 6 is a perspective view of a third embodiment of the tool handle of the invention in which both the outermost layer of the intermediate section and the grip end of the core have an undulated outer surface.

In another embodiment shown in FIG. 6, the outermost layer surrounding both the intermediate section and the grip end of the core can have an undulated outer surface. Another embodiment is shown in FIG. 7 in which only a portion of the outermost layer surrounding the intermediate section of the core has an undulated outer surface. The outermost layer surrounding the grip end is free from undulations. In this embodiment, there are about 4 to 6 undulations in the intermediate section. The location of these undulations can be varied to obtain the desired vibration dampening effect and appearance of the tool handle.

The tool handles of the present invention are particularly advantageous because they can be made from the same materials as prior art tool handle. Furthermore, they can be made from the same materials such as those disclosed in U.S. Pat. No. 5,056,381 herein incorporated by reference. Suitable materials for the core include metals such as steel as disclosed in U.S. Pat. No. 5,657,674 wherein a metal or steel skeleton is surrounded by a molded plastic shell. Typically, the core is made from a fiber reinforced resin mixture. Suitable resins include epoxy resin, polyester, vinyl ester. Unidirectional fibers used to reinforce the resin mixture include fiberglass, carbon fibers, fiberglass/carbon fibers, aramid fibers such as Kelvar.

In various embodiments of the invention, a variety of internal constructions of the core and tool handle can be used, including those disclose in U.S. Pat. Nos. 3,770,033, 5,375,486, 5,421,931, and 5,588,343.

The tool handles of the present invention can have more than one layer of material covering the core as shown in FIG. 5. An example of a multilayer construction is shown in U.S. Pat. No. 5,421.931.

The composition and properties of the layers depends upon the desire physical characteristics of the handle such as strength, flexibility, and weight. If there is more than one rigid layer, the outside surface of the outermost rigid layer has the undulated surface that acts to dampen vibration that is transmitted and felt by the user through the outermost rigid layer. In the embodiment shown in FIG. 5, the inner layer 20 is not required to be a rigid layer. However, if both inner layer 20 and layer 5 are rigid, then layer 5 is the outermost rigid layer whose outer surface is undulated.

The layers covering the core can be made from materials that are typically used in tool handles of the prior art. The choice of materials for the layers depends upon the desired characteristics of the handle such as the strength, flexibility, and weight of the handle. In the prior art, layers around the core are molded from resins that form rigid layers in order to strengthen the tool handle. However, these layers also transmit vibration to the grip end that is held by the user. In the present invention, the outermost rigid layer is undulated to dampen the vibration of impact that is transmitted from the head engaging end to the grip end through the rigid layer. The dampening effect is observed even when the outer surface of the rigid layer covering the grip end is free of undulations.

The outermost rigid layer of the present invention can be formed from synthetic resins such as such as vinyl ester, nylon derivatives, polycarbonates, or polyesters. Engineering plastics are particularly preferred because of their strengthening effect on the tool handle. In a preferred embodiment, the outermost rigid layer is a continuous layer of synthetic resin, preferably molded around the core.

The number of layers covering the core can vary depending upon the desired physical characteristics of the handle such as strength, flexibility, and weight. In FIG. 5, a two layer construction is shown with inner layer 20 surrounding core 6. The outermost rigid layer 5 surrounds both inner layer 20 and core 6. In another embodiment of the invention, the core and the layers covering the core could be made from same material. In this case, the outermost rigid layer constitutes the outer surface of the core.

Cores suitable for use in the present invention can have the construction of those disclosed in the prior art and can be made by known methods such as pultrusion. Methods of making the core, such as that disclosed in U.S. Pat. No. 5,421,931, herein incorporate by reference, could also be used. The rigid molded layers can be molded on the core or over other layers by known casting and molding methods such as injection molding. Such methods form a continuous outermost layer for the tool handle. The undulations in outermost molded layer are conveniently formed by tooling undulations of desired number and dimensions into the inner face of the mold that is used to form the outermost rigid layer. The undulations are preferably molded into the surface of the outermost rigid layer so that vibration passes into the undulations and is dissipitated. Thus the energy of the vibration is absorbed and not transmitted to the grip section creating discomfort, even injury to the user.

EXAMPLES AND COMPARATIVE TESTS

The tool handles according to the invention were attached to hammer heads and compared with similar commercially available hammers, including hammers advertised as having anti-vibration properties. The hammer handles used in the following tests had the following dimensions: length of tool handle—12.75 in., length of grip end—5.25 in., length of tool engaging end—1.5 in., length of intermediate section—6 in., diameter of core—1 in., thickness of the intermediate layer—⅛ inch, and thickness of the outermost layer—⅛ to ¼ inch.

The undulations were arc shaped and evenly spaced on the intermediate section of the outermost layer only, not on grip end. The height of undulations ranged from 0.5 to 1 mm and the distance between peaks undulation was about 12 mm.

| | |
|---|---|
| Hammer 2 | Core: solid fiberglass/epoxy resin composite<br>Outermost layer: modified vinyl ester tooling resin with fiber filler<br>Intermediate section had 11 undulations in the outer surface |
| Hammer 3: | Core: solid fiberglass/carbon fiber/epoxy resin composite<br>Outermost layer: modified vinyl ester tooling resin with fiber filler<br>Intermediate section had 11 undulations in the outer surface |
| Hammer 4: | Core: solid fiberglass/epoxy resin composite<br>Outermost layer: modified vinyl ester tooling resin with fiber filler<br>Intermediate section had 10 undulations in the outer surface |

Procedure for Testing Hammers Made with Tool Handle of the Invention

In order to simulate the location in which the hammer would be gripped during use, the handle was secured using a machinist's vise located about 9 ⅞ inches from the top of the hammer head. Two accelerometers where mounted onto a square block, and then secured to the handle by means of a mounting bracket. The mounting bracket was secured to the handle using two bolts torqued to 25 inch-lbs. The accelerometers were located about 9.0 inches from the top end of the hammer head. One accelerometer was located in the vertical direction and the other accelerometer was located in the horizontal direction.

The handle was positioned with the narrow side in a horizontal plane (verified via a bubble balance) so that the impact to the end of the handle was applied at a 90 degree angle as would occur when the hammer is in use. The hammer was struck with an applied energy of 12 inch-lbs and 24 inch-lbs with results of each impact being simultaneously recorded by a calibrated data acquisition system. The hammer was subjected to two impact tests. The point of impact was in the center of driving end of the hammer head. The vice used to secure the hammer handle was torqued to 75 in-lbs.

The sensing of vibration by the human hand during the use of an impact tool such as a hammer is related to the vibration frequency, the vibration amplitude, and the duration of the vibration. A higher frequency (short period) has a greater effect on the hand than a lower (long period) vibration. A higher amplitude vibration also has a greater effect and is sensed more quickly by the hand. Reduction (dampening) of the duration of the vibration reduces the effect on the hand of the user. Therefore, lowering of the frequency and duration of the vibration is beneficial to the user's hand and arm during use of the hammer.

TABLE 1

| Sample | Vibration Frequeney (Hz) | Duration of vibration (sec) |
|---|---|---|
| Hammer 2 (without rubber grip) | 40 Hz | 0.6 |
| Hammer 3 (without rubber grip) | 50 Hz | 0.5 |
| Anti-vibration Hammer* (without rubber grip) | 85 Hz | 0.45 |
| Anti-vibration Hammer* | 18 Hz | 0.5 |
| Hammer 2G** | 28Hz | 0.3 |

*Commercially available anti-vibration hammer
**Hammer 2 with silicone rubber tape wrapped around grip end

TABLE 2

| Sample | Vibration Frequeney (Hz) | Duration of vibration (sec) |
|---|---|---|
| Hammer 4 (with rubber grip) | 17 Hz | 0.2 |
| Anti-vibration Hammer | 18 Hz | 0.5 |

TABLE 3

| Sample | Vibration Frequency (Hz) | Duration of Vibration (sec) |
|---|---|---|
| Hammer 3G* | 22 Hz | 0.30 |
| Standard Hammer** | 25 Hz | 0.60 |

*Hammer 3 with molded rubber grip and 20 oz. head
**commercially available hammer with same type ofmolded grip as Hammer 3G and same 20 oz. head The comparative tests show that tool handles according to the invention produce a significant improvement in vibration dampening and/or in reducing vibration frequency when compared to tool handles that do not have undulations in their outer surfaces.

Tool handle according to the invention can be used in a variety of impact tools including, but not limited to, hammers of all kinds, axes, picks, hatchets, shovels and similar impact tools in which vibration is transmitted from the point of impact to the grip section of the handle.

What is claimed is:

1. A tool handle comprising, a core having a tool engaging end, an intermediate section, and a grip end and one or more rigid molded layers which completely or partially cover at least part of the intermediate section, wherein the one or more rigid molded layers include an outermost rigid layer having an undulated outer surface containing a plurality of undulations.

2. The tool handle of claim 1 wherein the outermost rigid layer covers the grip end.

3. The tool handle of claim 2 wherein a portion of the outermost rigid layer covering the intermediate section is undulated and a portion of the outermost rigid layer covering the grip end is free of undulations.

4. The tool handle of claim 3 wherein the outer surface of the outermost rigid layer covering the intermediate section has 9 to 11 undulations.

5. The tool handle of claim 3 wherein the outer surface of the outermost rigid layer covering the intermediate section has 4 to 11 undulations.

6. The tool handle of claim 1 wherein the outer surface of the outermost rigid layer covering the intermediate section and the grip end is undulated.

7. The tool handle of claim 6 wherein a portion of the outer surface of the outermost molded layer covering the intermediate section of the core is undulated.

8. The tool handle of claim 7 wherein the outer surface of the outermost molded layer covering the intermediate section of the core has 4 to 6 undulations.

9. The tool handle of claim 1 wherein the core is comprised of a material selected from the group of composites, metals, synthetic resin, and mixtures thereof.

10. The tool handle of claim 9 wherein the core is cylindrical and comprised of a composite material.

11. The tool handle of claim 10 wherein the composite comprises a fiber reinforced synthetic resin wherein the reinforcing fibers are selected from the group consisting of fiberglass, carbon fibers, and polyaramid fibers and mixtures thereof.

12. The tool handle of claim 9 wherein the material is a metal.

13. The tool handle of claim 12 wherein the metal is steel.

14. The tool handle of claim 9 wherein the core is cylindrical and comprised of a solid synthetic resin.

15. The tool handle of claim 14 wherein the synthetic resin is selected from the group consisting of epoxy resin, polyester, and vinyl ester.

16. The tool handle of claim 1 wherein the outermost rigid layer comprises a continuous layer comprised of a synthetic resin.

17. The tool handle of claim 16 wherein the outermost rigid layer comprises a synthetic resin selected from the group consisting of vinyl ester resin, nylon derivatives, polycarbonate resin, and polyester resin.

18. The tool handle of claim 1 wherein the outermost rigid layer is molded around the core and the undulations are molded into the outer surface of the outermost rigid layer.

19. The tool handle of claim 1 wherein the core and the rigid molded layers covering the core are comprised of the same material.

20. A tool handle comprising, a core having a tool engaging end, an intermediate section, and a grip end and one or more rigid molded layers which completely or partially cover at least part of the intermediate section, wherein the one or more rigid molded layers include an outermost rigid layer having an undulated outer surface containing a plurality of undulations that are longitudinally spaced along the length of the outermost rigid layer and extend around the circumference of the outermost rigid layer.

21. The tool handle of claim 20 wherein the outer surface of the outermost rigid layer covering a portion of the intermediate section of the core is undulated.

22. The tool handle of claim 21 wherein the outer surface of the outermost molded layer surrounding the intermediate section of the core has 4 to 6 arc shaped undulations.

23. A tool handle according to claim 20 wherein the grip end is completely or partially covered with one or more rigid layers wherein the outermost rigid layer covering the grip end has an outer surface that is free of undulations.

24. The tool handle of claim 23 wherein the outer surface of the outermost rigid layer covering the intermediate section of the core has 9 to 11 arc shaped undulations.

25. An impact tool comprising a head and a tool handle joined to the head, the tool handle comprising a core having a tool engaging end, an intermediate section, and a grip end and one or more rigid molded layers which completely or partially cover at least part of the intermediate section, wherein the one or more rigid molded layers include an outermost rigid layer having an undulated outer surface containing a plurality of undulatins.

26. An impact tool according to claim 25 selected from the group consisting of a hammer, axe, hatchet, pick, and shovel.

* * * * *